US005189883A

United States Patent [19]

Bradford

[11] Patent Number: 5,189,883

[45] Date of Patent: Mar. 2, 1993

[54] ECONOMICAL REFRIGERATION RETROFIT SYSTEMS

[75] Inventor: Gene H. Bradford, Houston, Tex.

[73] Assignee: Natkin & Company, Englewood, Colo.

[21] Appl. No.: 867,510

[22] Filed: Apr. 13, 1992

[51] Int. Cl.[5] ..... F25B 41/00

[52] U.S. Cl. ..... 62/83; 62/114; 62/503

[58] Field of Search ..... 62/77, 83, 114, 149, 62/197, 292, 298, 503, 508

[56] References Cited

U.S. PATENT DOCUMENTS

| | | | |
|---|---|---|---|
| 3,942,332 | 3/1976 | Schumacher | 62/217 |
| 4,258,553 | 3/1981 | Kelly et al. | 62/117 |
| 4,599,873 | 7/1986 | Hyde | 62/498 |
| 4,619,115 | 10/1986 | Weber | 62/217 |
| 4,739,632 | 4/1988 | Fry | 62/505 |
| 4,974,427 | 12/1990 | Diab | 62/505 |
| 4,977,751 | 12/1990 | Hanson | 62/81 |
| 5,063,749 | 11/1991 | Manz | 62/149 |

*Primary Examiner*—Henry A. Bennet
*Assistant Examiner*—William C. Doerrler
*Attorney, Agent, or Firm*—Rothgerber, Appel, Powers & Johnson

[57] ABSTRACT

An economical method for converting a compression type refrigeration system designed for the use of R-12 refrigerant, comprising an evaporator, a compressor rated for R-12, a condenser, and a receiver, to the use of R-22 refrigerant without replacing the compressor or other major pieces of equipment. The retrofit comprises the installation of a pressure regulator in the suction line to the compressor and the balancing of the regulator to the operating limitations of the compressor motor; the installation of a line into the body of the compressor sufficient to inject liquid refrigerant into the compressor for cooling purposes; and the attachment of a desuperheating control to the refrigerant injection line to control the amount of refrigerant injected based upon the temperature inside the compressor. In many embodiments it is also advisable to install a pressure regulator at the outlet of the evaporator to maintain design temperature in the evaporator. In the preferred embodiment of the invention, a pump is also installed in the line between the receiver and the evaporator to prevent flashing in that line, reduce the amount of refrigerant needed to decrease the load on the compressor and eliminate the need for imposing an artificial head pressure for refrigerant circulation.

17 Claims, 3 Drawing Sheets

ECONOMICAL REFRIGERATION RETROFIT SYSTEMS

BACKGROUND OF THE INVENTION

This invention relates generally to the field of mechanical or compression type refrigeration systems of the type frequently employed in commercial and industrial applications for "low" or "medium" temperature applications. In particular, the invention relates to an economical means to convert or "retrofit" refrigeration systems designed for the use of traditional chlorofluorocarbons ("CFC's"), specifically the refrigerant known as "CFC-12" or "R-12," to the use of environmentally more desirable refrigerants having different operating characteristics, in particular, the refrigerant known as "R-22."

Nearly twenty years ago, a theory was espoused that CFC's being released into the environment were reducing the amount of ozone in the atmosphere. Ozone serves as a filter to protect the Earth from harmful ultraviolet rays. In 1987 the National Aeronautical and Space Administration ("NASA") published a report that directly linked CFC's with ozone depletion. Scientists have further stated that during the period 1969 to 1986 the protective ozone layer was reduced 1.7 percent to 3.0 percent in certain latitudes of the Northern Hemisphere. Reduction in the earth's ozone layer has been blamed for the advent of "global warming" with its many side effects, such as an increased risk of skin cancers.

The Clean Air Act Amendments of 1990 contain drastic controls and regulatory requirements for the production and use of CFC's. Among the requirements are phaseouts of the production of certain CFC's and strict regulations regarding the transfer and handling of CFC's. These regulations and controls will significantly affect the costs of servicing, maintaining, and operating refrigeration and air conditioning systems that utilize CFC's. CFC production is being curtailed and is scheduled for total phaseout.

Based on further NASA test results indicating that the accumulation of ozone depleting chemicals in the atmosphere is larger than expected, the governments in both the United States and Japan have recently announced plans to accelerate the "phase out" of CFC production and use.

One of the CFC's targeted by such programs is CFC-12, commonly known to the refrigeration and air conditioning industry as "R-12" refrigerant. Other refrigerants, such as R-22, an "HCFC" refrigerant, are far less damaging to atmospheric ozone than is R-12 due to the fact that they contain substantially less chlorine. Like R-12, R-22 cannot be freely vented to the atmosphere and must be recovered during servicing procedures, but R-22 continues to be "acceptable" under current regulations which permit R-22 to be manufactured without restriction until the year 2020, when it will begin to be phased out by year 2030.

The design of a refrigeration system is generally predicated on the choice of the specific material to be utilized as the refrigerant. R-12 refrigerant has been in use since 1931. Because of excellent stability and a high affinity for oil, R-12 was the predominant choice for use in "low" or "medium" temperature applications. ("Medium" temperature applications are generally those in which the evaporator coil temperature is approximately 5° F. to 20° F., which generally corresponds to a refrigeration "box" temperature of approximately 20° F. to 40° F. "Low" temperature applications are those in which the evaporator coil temperature is 5° F. or lower.) Thus, R-12 was used in the design and operation of refrigeration systems typically employed in restaurants, supermarkets, dairy stores and fast food outlets. The physical and thermodynamic properties of R-12 refrigerant dictated many of the design features of such systems including, for example, the type, size and operating parameters of the compressor.

The phase out of R-12 in favor of other refrigerants, such as R-22, is not a simple matter of removing the refrigerant from the existing refrigeration system and replacing it with the environmentally preferred material, i.e., like an oil change. The physical and thermodynamic properties of R-22 refrigerant are significantly different from those of R-12 such that the refrigeration system operates with different performance parameters (e.g., compressor head temperature and pressure) than those required by R-12. For example, the higher enthalpy characteristics of R-22 means that less refrigerant is required in the refrigeration system, but that the system must be operated at a higher pressure. The low pressure side of a typical compression type refrigeration system utilizes 9 psig. to 29 psig with R-12 and 24 psig. to 54 psig. with R-22; the high pressure side utilizes 136 psig. with R-12 and 226 psig. with R-22. In fact, R-22 refrigerant was designed for "high" temperature applications (i.e., those generally involving the normal range of operation of room air conditioning systems) and not for the "low" and "medium" temperature applications in which efforts are now being made to utilize it as a replacement for R-12.

The invention described herein is intended to apply to refrigeration systems in which the compressor is "rated" for R-12, i.e., it has a published rating for R-12, and possibly also R-502 refrigerant, but not for R-22. Common "wisdom" in the industry is that the R-12 rated compressors in refrigeration systems designed for R-12 must be replaced when converting the system to the use of R-22 refrigerant. (See, for example, "Refrigerants: What's Next," *Engineered Systems*, March 1991, pp. 50–52; "Using HCFC-22," *Heating/Piping/Air Conditioning*, November, 1991, pp. 64 to 72). Manufacturers of such equipment have stated that operation of a refrigeration system designed for R-12 with R-22 refrigerant would quickly result in overheating, overloading and destruction of the compressor. Accordingly, all commercially known suggestions to convert existing compression type refrigeration systems designed for the explicit use of R-12 to the use of R-22 or other available substitutes call for the replacement of the compressor. In many systems the conversion from R-12 to R-22 will also require supplementation of existing condenser capacity, primarily through the replacement of this expensive piece of equipment. Thus, users of refrigeration systems with compressors designed and rated for R-12 are confronted with significant costs of replacing equipment that has not completed its useful life.

Conversion of systems designed for R-12 to the use of R-22 is very expensive, particularly for certain industries, such as retail supermarkets and groceries. Because of the differing temperature requirements for the variety of products in a typical supermarket (e.g. produce, dairy products, cheese and meats), each supermarket must have numerous R-12 refrigeration systems, one for each zone with particular temperature needs. The average supermarket has 15 to 25 refrigeration systems with some supermarkets having as many as 40. The cost for a typical supermarket to convert its refrigeration systems from R-12 to environmentally preferred materials requires a minimum of at least one hundred thousand dollars. In addition to these capital costs, the increased capacity of the compressor and the condenser result in significantly increased energy consumption and operating costs on a continuing basis. In contrast, the retrofit system of this invention reduces these capital costs by at least, approximately forty percent (40%) without increasing the energy consumption or operating costs of the resulting retrofit system.

Many supermarket chains and refrigeration equipment suppliers have been concerned about the cost of the CFC conversions and have been searching for solutions to the problem. Nevertheless, prior to my invention no one has found an economical way to utilize the environmentally preferred refrigerants in existing commercial and industrial refrigeration systems designed for the use of R-12. Attempts have been made to utilize other refrigerants to replace R-12 without requiring expensive equipment replacement. These efforts have been unsuccessful. And despite significant economic incentives, to date refrigerant suppliers have been unable to develop a direct, i.e., "drop in," replacement refrigerant to substitute for R-12 which: (1) poses significantly reduced environmental risks, and (2) has physical and thermodynamic properties similar enough to R-12 that expensive equipment replacement is not required in the conversion of existing R-12 based systems.

SUMMARY OF THE INVENTION

I have now discovered an economical method for converting a compression type refrigeration system designed for the use of R-12 refrigerant, including an evaporator, a compressor rated for R-12 refrigerant, a condenser, and a receiver, to the use of R-22 refrigerant without replacing the compressor or the evaporator. The retrofit comprises the installation of a pressure regulator in the suction line to the compressor and the balancing of the regulator to the operating limitations of the compressor motor; the installation of a line into the body of the compressor sufficient to inject liquid refrigerant into the compressor for cooling purposes; and the attachment of a desuperheating control to the refrigerant injection line to control the amount of refrigerant injected based upon the temperature inside the compressor. In many instances it is also desirable to install a pressure regulator at the outlet of the evaporator to maintain design temperature in the evaporator.

In the preferred embodiment of the invention, a pump is also installed in the line between the receiver and the evaporator to prevent flashing in that line, reduce the amount of refrigerant needed to decrease the load on the compressor and eliminate the need to impose head pressures for refrigerant circulation.

Accordingly, it is an object of the invention to provide a refrigeration system that utilizes R-22 in low and medium temperature applications, decreasing the risk of environmental damage from operation of the system.

Specifically, it is an object of the present invention to provide a retrofit system for converting a refrigeration system to one employing a refrigerant requiring greater pressure, which retrofit system eliminates the need for imposing greater compressor head pressure.

It is an additional object of the invention to provide a retrofit system for converting a refrigeration system designed for the use of R-12 refrigerant to the use of R-22 without replacing any of the major pieces of equipment.

It is a further object of the invention to provide a retrofit system for converting a refrigeration system designed for the use of R-12 refrigerant to the use of R-22 which avoids any significant increase in energy consumption or other operating costs.

Further objects of the invention will be apparent from the description of the invention in the drawings and written specification contained herein including, without limitation, the detailed description of the preferred embodiment.

The drawings are not to scale, but are intended merely to depict the arrangement of the equipment, devices and lines shown.

DESCRIPTION OF THE INVENTION AND THE PREFERRED EMBODIMENT

I have now discovered a retrofit to existing refrigeration systems designed for R-12 refrigerant in low and medium temperature applications which will allow R-22 refrigerant to be substituted for R-12 without the need for replacing any major pieces of equipment, particularly the compressor.

Figure 1:
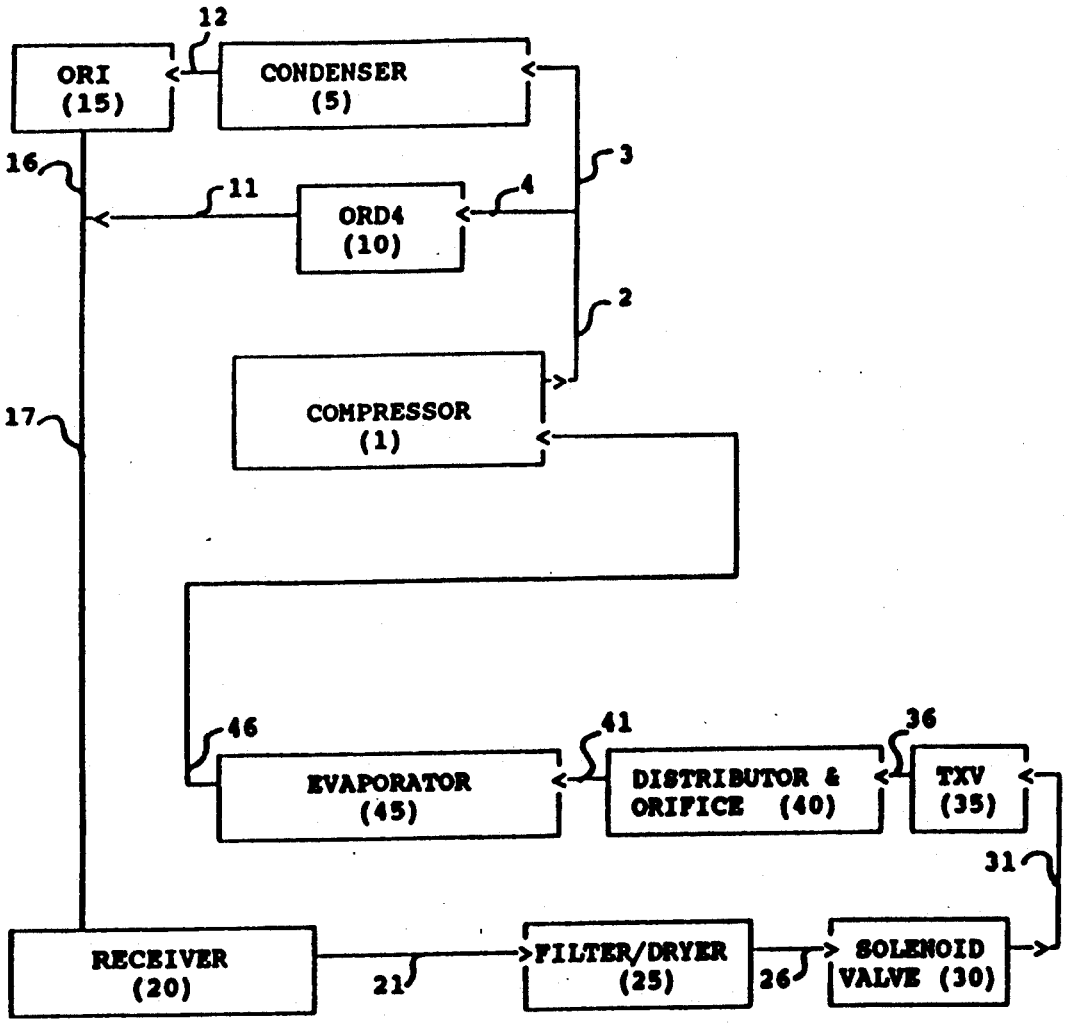
FIG. 1 is a schematic showing the arrangement of equipment in a typical refrigeration system utilized in both "low" or "medium" temperature applications in commercial and industrial applications, such as supermarkets, restaurants, hospitals and other institutions or establishments, particularly those involving food storage or preparation.

FIG. 1 represents a conventional mechanical refrigeration system of the type utilized for cooling and refrigeration in supermarkets and, prior hereto, has been operated utilizing a CFC refrigerant, such as, R-12. The system consists of a compressor 1 which compresses refrigerant vapor and discharges it through lines 2 and 3 into a condenser 5. The condenser 5 liquefies the refrigerant, which then flows through lines 16 and 17 into receiver 20. The ORI 15 and ORD 10 are control valves installed in parallel with lines 4, 11, 12 and 16 as shown in FIG. 1 to impose artificial head pressure to provide flow of refrigerant to the thermostatic expansion valve ("TXV") under low ambient temperature conditions. "ORI" and "ORD" are trademarks of Sporlan Industries of St. Louis, Mo. for head pressure control valves. The devices 10 and 15 are installed in accordance with the manufacturer's recommendations.

The receiver 20 stores refrigerant when it is not needed and ensures that enough refrigerant is available to provide a liquid seal at the TXV 35 and to fill eighty percent (80%) of the condenser 5 with refrigerant to reduce surface area and, therefore, heat exchange capacity under low ambient temperature conditions. These criteria are utilized in charging the system with the proper amount of R-12 refrigerant.

From receiver 20 the liquid refrigerant flows via line 21 through the filter/dryer 25 and solenoid valve 30. The solenoid prevents migration of refrigerant to the evaporator. The refrigerant then flows through line 31 through the thermostatic expansion valve ("TXV") 35 and into the evaporator 45. The TXV 35 meters the liquid refrigerant flow into the evaporator through line 36, the distributor and orifice 40, and line 41. Passing through the evaporator 45, the refrigerant, through change of state, absorbs heat and then returns to compressor 1 through line 46 in the form of superheated vapor.

The refrigerant temperature in the condenser 5 is generally maintained at approximately 110° F. to suppress the liquid refrigerant from flashing into gas. To do this, pressure levels in the receiver 20 are maintained above the flash or boiling point of the refrigerant. These temperature and pressure levels are sufficient to suppress flash gas formation in lines 21, 26 and 31.

The foregoing describes a refrigeration system of the type which has been utilized with R-12 refrigerant in millions of commercial and industrial systems. The details of these systems may be different in individual cases, but the basic system features, including compressor, condenser, receiver and evaporator are present in each. With the exception of recently installed systems which have been predicated on the likely phasing out of R-12 refrigerant, the equipment in such systems, particularly the compressor, was generally designed and sized, i.e., "rated," for R-12 refrigerant taking into account the physical and thermodynamic properties of that material. In particular, the compressors in such systems have generally been rated specifically for R-12 refrigerant and have been sized so that the compressor cycles in a manner maintaining the proper pressure in the evaporator for R-12 refrigeration under the anticipated conditions of use.

As noted above, current regulations require a phasing out of R-12 production and the conversion of existing refrigeration systems to the use of environmentally safer materials of which R-22 is currently the most practical available alternative. The industry generally believes that compressors rated for R-12 refrigerant are inadequate to meet the demands imposed by replacement with R-22 refrigerant in such systems and that these compressors must be removed and replaced with R-22 rated devices. It is also frequently necessary to add additional condenser capacity. The resulting system requires more electricity to operate. Thus, the conversion results in significant capital costs as well as increased costs of operation.

The retrofit system of the present invention permits modification of an R-12 designed compression refrigeration system to the use of R-22 without changing the compressor. Also, it is unnecessary to add more condenser capacity. The costs of operating the retrofit system are essentially the same as in the original refrigeration system.

Figure 2:
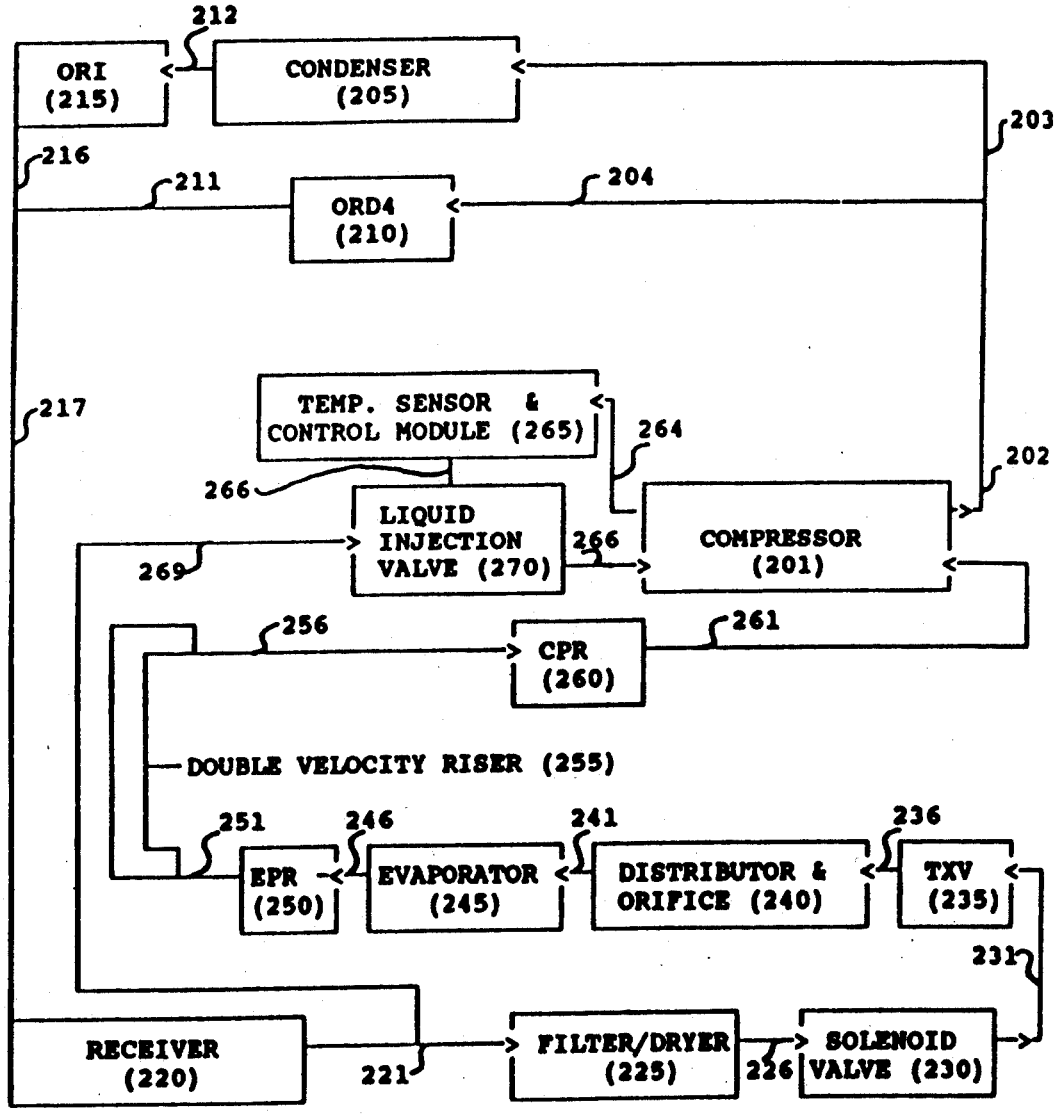
FIG. 2 is a schematic showing the arrangement of equipment in the refrigeration system of FIG. 1 retrofitted in accordance with one embodiment of the present invention.

A retrofit system in accordance with this invention is illustrated, for example, in FIG. 2. FIG. 2 represents the conventional mechanical refrigeration system as described in FIG. 1, i.e., designed for using R-12, with modifications permitting the same equipment to operate with R-22 refrigerant. For convenience, pieces of equipment common to FIG. 1 have been given the same reference number increased by 200.

FIG. 2 shows the retrofit refrigeration system comprising the same R-12 rated compressor 201 which compresses refrigerant vapor and discharges it through lines 202 and 203 into condenser 205. The compressor 201 has been modified in several significant respects. First, a crankcase pressure regulator ("CPR") 260 is added in line 261 to the suction port of the compressor 201 and acts much like an "unloader" to limit the capacity of the compressor. In addition, the compressor 201 has been modified, as described in more detail below, to permit the injection of liquid refrigerant through line 266 into the compressor for cooling purposes. This refrigerant is taken via line 269 from line 221 between the receiver 220 and the filter/dryer 225. The flow of refrigerant into the compressor 201 via lines 269 and 266 is controlled by a temperature sensor and control module 265, which measures the temperature in the compressor and controls liquid injection valve 270 to permit more or less refrigerant to be injected depending on the cooling needs of the compressor.

As in FIG. 1, the condenser 205 liquefies the refrigerant, which then flows through lines 212, 216 and 217 into receiver 220. ORI 215 and ORD 210 perform the same functions as described with respect to FIG. 1 and are connected in parallel via lines 204, 211, 212 and 216 as depicted in FIG. 2. From receiver 220 the liquid refrigerant flows via line 221 through the filter/dryer 225 and solenoid valve 230. The refrigerant then flows through line 231 through the thermostatic expansion valve ("TXV") 235 and into the evaporator 245. The TXV functions to meter the liquid refrigerant flow through line 236, distributor and orifice 240 and line 241 into the evaporator coil 245. Change of state of the refrigerant occurs in the evaporator and heat is absorbed through this process thereby providing a cooling effect.

The gases exiting the evaporator 245 then pass through line 246 into evaporator pressure regulator ("EPR") 250, which controls the pressure of the gases in the evaporator and, hence, the temperature in the evaporator as described below.

After exiting the EPR through line 251, the refrigerant enters a double velocity riser 255 which has been added to ensure the adequate return of oil and refrigerant to the compressor. It should be noted that the addition of the double velocity riser may not be required for the conversion of all R-12 systems to R-22. Velocity risers are not required when lines 251, 256 and 261 are graded downward to the compressor 201 location and no lift requirements are imposed. After leaving the double velocity riser through line 256, the refrigerant then passes into CPR 260 for return to the compressor 201 via line 261.

As shown in FIG. 2, the liquid refrigerant that is recirculated via line 269 for injection into and cooling of the compressor 201 originates from a point between the receiver 220 and the filter/dryer 225 at line 221. It is also possible that this liquid refrigerant could be taken from other points between the receiver and the TXV, such as line 226 or line 231.

In addition to the modifications shown on FIG. 2, the system should generally be modified in several additional respects. First, all metering devices, such as distributors, orifices and expansion valves (such as TXV 235) which are rated for R-12 use only should be replaced with similar devices sized for R-22, which, as noted previously, operates with different temperatures and pressures than R-12. Second, if the compressor head pressure control is rated only for R-12, it should be replaced with an R-22 rated device. Typically, ORI 215 and ORD 210 are rated for both R-12 and R-22 and do not have to be replaced. Finally, for safety of life and property, any and all relief valves must be replaced with R-22 pressure rated valves.

The foregoing generally describes the features of one preferred embodiment of my invention. Particular attention, however, should be paid to the following items.

An R-12 rated compressor operating with R-22 refrigerant in a refrigeration system which has not been modified in accordance with my invention will experience motor overloading and excessive discharge temperatures which will result in either rapid overheating of the compressor or will at least be sufficiently high to accelerate oil breakdown and result in damage to the compressor and motor over a period of time. As noted above, one of the modifications included in the retrofit system of this invention is the injection of refrigerant into the compressor which aids in preventing such overloading. This is accomplished by drilling and tapping an opening in the compressor body to insert a line for injection of the liquid refrigerant into the compressor. The hole should be drilled under the application of positive pressure inside the compressor with a magnet located at the drill bit or tap on the exterior of the compressor, so that the metal shavings from the drill bit exit the hole to the outside and do not drop into the motor where they could assist in causing deterioration or other injury to the compressor.

Preferably, the refrigerant should be injected into the compressor downstream of the crankcase, motor and stator and immediately upstream of the gas flow to the suction valve where the compressor is the hottest, i.e., between the crankcase and the upper head. Since a compressor is designed to operate with gases, it is undesirable to have liquid in it, particularly, at the crankcase and motor, even when the liquid is one containing entrained oil in amounts typically present in the refrigerant which is recirculated for injection in this case. I have found, for example, that a particularly good place to inject the refrigerant is through the cover plate on the compressor, as in R-12 rated semi-hermetic compressors.

Because of the incompatibility of liquids in a compressor, I have found it desirable to inject the refrigerant through a tube extending into the compressor body. The tube should be sufficiently long, i.e., generally about 6 to 8 inches, so that the liquid refrigerant is heated and flashes into a gas as it exits the tube in the compressor. Copper tubing is useful, since it conducts heat readily. Preferably, the tube also has a slight bend in the end of it to direct the exiting refrigerant toward the hot cylinder wall to maximize the cooling of incoming suction gas, thereby eliminating stratification of the suction gas.

The refrigerant injection line should be sufficiently sized for the size of the compressor involved. Typically, tubing with a minimum ⅜ inch internal diameter should be used. The amount of liquid injected at any time is controlled by a desuperheating control utilizing a thermostat located in the compressor, preferably, in the high side of the compressor, such as the front of the head. For example, a "Discus Demand Cooling" system manufactured and sold by Copeland Manufacturing Company in Sydney, Ohio can be used. Some existing compressors have a port located at this position through which the thermostat can be easily inserted.

In the absence of the retrofit system of this invention, an R-12 rated compressor, operating with R-22 refrigerant, is capable of more capacity than is needed, causing the motor to operate in overload conditions which could result in motor damage and or failure. As noted previously, a pressure regulator ("CPR") is installed in the suction line to the compressor and balanced to the operating limitations of the motor. The CPR operates to limit the pressure at the suction port of the compressor and acts as an "unloader." The CPR should be sized sufficient to permit original system design compressor performance (based on the original system design criteria) using charts generally available with these devices. An oversized CPR should be avoided, but the CPR should be sized sufficient to permit original system design compressor performance utilizing R-22. The purpose of the CPR is to limit the pumping capacity to the design capacity (i.e., brake horsepower) of the motor within its name plate limits. This is accomplished by adjusting the CPR using means provided by the manufacturer on that device until the name plate load of the compressor is achieved as indicated by the ampmeter reading on the motor.

As mentioned previously, to maintain evaporator design temperature conditions, a pressure regulator (EPR) is installed at the evaporator outlet. This is used to maintain control of the actual devices, e.g., fixtures in a grocery store, for delivering the refrigeration effect. The EPR controls the pressure of the refrigerant leaving the evaporator and, therefore, the temperature. The use of the EPR eliminates "cycling" of the compressor as the temperature of the exiting gases would normally be fluctuating. It also helps the system to rapidly stabilize to the load after start-up without cycling. With the EPR, the compressor runs continuously. The EPR is set after the CPR is properly adjusted. With the system in operation at that time, the EPR is set so that the desired design temperature of the evaporator is established to achieve the requisite cooling of the load. The EPR can be located immediately after the evaporator, i.e., in line 246 as shown in FIG. 2, or after the refrigerant has passed through the double velocity riser, i.e., in line 256 of FIG. 2.

Due to the enthalphy difference between R-12 and R-22, less R-22 is required to produce the same refrigeration effect. Oil is entrained in the refrigerant and circulates with the refrigerant. With less refrigerant, and a subsequent reduction of oil and refrigerant circulation, a condition of insufficient oil return to the compressor could exist. A double riser is installed to assure constant velocity sufficient to return oil to the compressor at the various loads encountered by the refrigeration system.

Finally, it should be noted that installation of the retrofit system as depicted in FIG. 2 results in increased work load of at least approximately 7–11% on the condenser. If the original condenser was overdesigned or constructed with a "safety factor" sufficient to accommodate these increased requirements, no modification need be made. However, in many, if not most, applications, the condenser has not been designed with sufficient excess capacity to accommodate the added requirements of conversion to R-22 refrigerant, and it will be necessary to add a supplemental compressor unit (which is not a viable long-term solution) or to replace the condenser with a larger unit. The latter solution requires significant expense, particularly in sites, such as supermarkets, with multiple refrigeration systems which frequently share one or more condensers.

In the preferred embodiment of the invention, the features described previously are utilized in conjunction with a further modification consisting principally of the use of a pump in the liquid refrigeration line between the receiver and the evaporator. This acts to ensure that there is a constant liquid seal at the TXV valve. This pump does part of the work of the compressor. Accordingly, the load on the compressor is significantly reduced through the lowering of the condenser temperature and head pressures corresponding to ambient temperature. This preferred embodiment has a number of additional benefits: First, the use of the pump desuperheats the condenser thereby giving the condenser greater capacity and eliminating the need for additional condenser capacity. By desuperheating the condenser, there is no need for desuperheating refrigerant in the condenser. Second, the amount of refrigerant charged in the system is substantially less, thereby decreasing the environmental risks imposed by operation of the refrigeration system. Third, the resulting retrofit system evidences the greatest energy savings during operation as compared to other methods of converting the R-12 refrigeration system to R-22.

Figure 3:
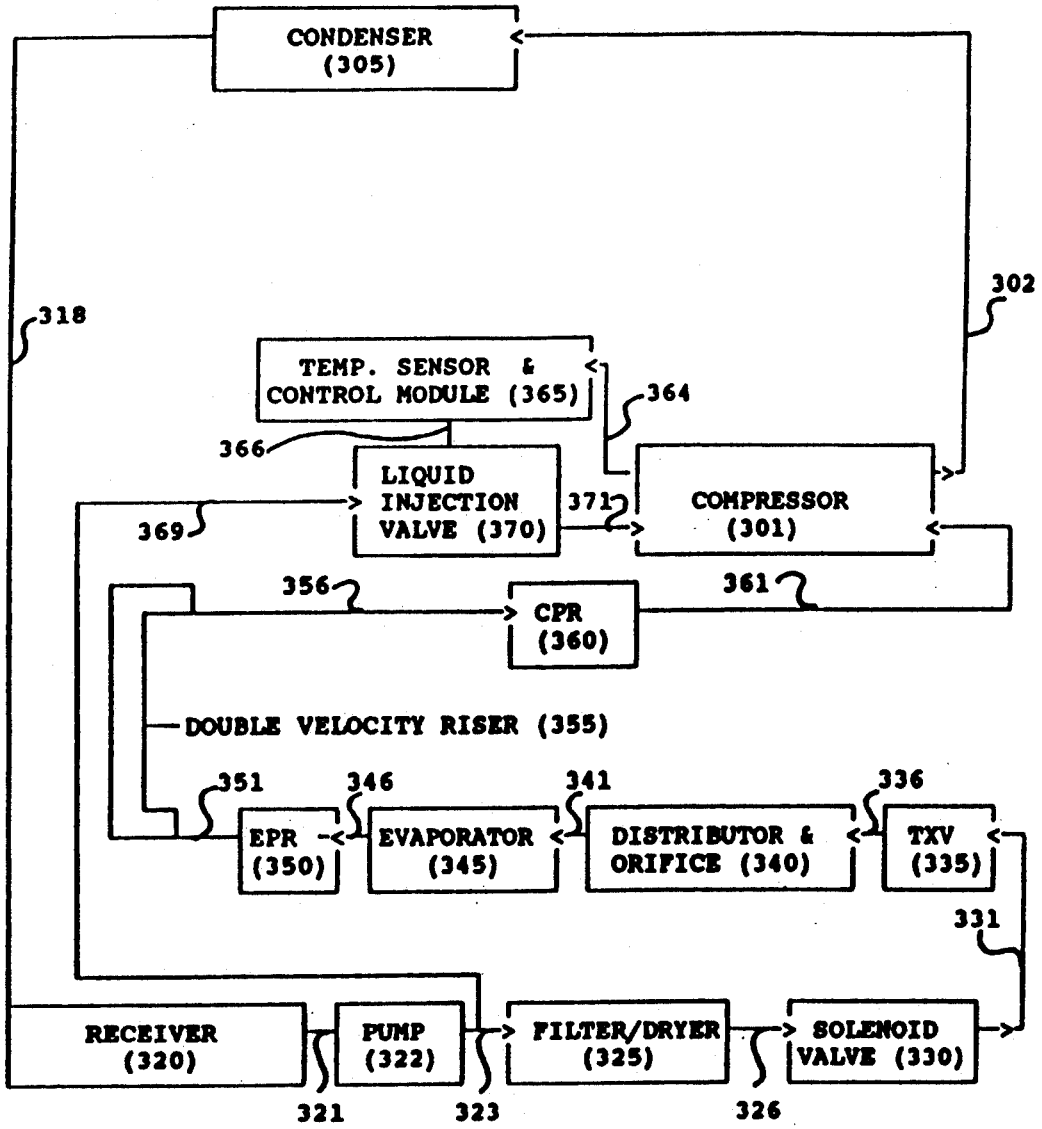
FIG. 3 is a schematic showing the arrangement of equipment in the refrigeration system of FIG. 1 retrofitted in accordance with the preferred embodiment of the present invention.

The system of this preferred embodiment is illustrated for example in FIG. 3. FIG. 3 represents the conventional mechanical refrigeration system of the type described in FIG. 1 designed for using R-12 with modifications permitting the same equipment to operate with R-22 refrigerant. For convenience, pieces of equipment in FIG. 2 that are common to the system to be retrofitted as shown in FIG. 1 are given the same reference number increased by 300.

The retrofit refrigeration system in FIG. 3 consists of the same R-12 rated compressor 301 which compresses refrigerant vapor and discharges it through line 302 into condenser 305. The compressor has again been modified by the addition of a CPR 360 to the suction port of the compressor via line 361 and the injection of liquid refrigerant through line 371 into the compressor 301 for cooling purposes. The flow of refrigerant into the compressor via line 369 and 371 is again controlled by a temperature sensor and control module 365, which measures the temperature in the compressor and controls liquid injection valve 370 to permit more or less refrigerant to be injected depending on the temperature needs of the compressor.

As in the system of FIG. 2, the condenser 305 liquifies the refrigerant, which then flows through line 318 into receiver 320. From receiver 320 the liquid refrigerant flows via line 321 into a pump 322. The pump contains sufficient capacity, when properly sized to line losses and system BTU rating, to provide R-22 liquid refrigerant flow requirements for the evaporator 345. The pump should be located after the receiver, but should be located as close to the receiver as possible. Due to the pressure added at this point by the pump 322, the ORI and ORD valves shown in FIGS. 1 and 2 can be eliminated.

Pressurized liquid refrigerant then leaves pump 322 through line 323 to the filter/dryer 325 and then via line 326 to solenoid valve 330. The refrigerant then flows through line 331 through the thermostatic expansion valve ("TXV") 335 and into the evaporator 340. The TXV meters the liquid refrigerant which flows into and through the evaporator through line 336, the distributor and orifice 340 and line 341. Passing through the evaporator 345, the refrigerant under goes change of state and absorbs heat.

The gases exiting the evaporator 345 then pass through line 246 into evaporator pressure regulator ("EPR") 350, which controls the pressure of the gases in the evaporator and hence the temperature in the evaporator as described previously.

After exiting the EPR through line 351, the refrigerant enters a double velocity riser 355 which has been added to ensure the adequate return of oil and refrigerant to the compressor. It should be noted that the addition of the double velocity riser may not be required for the conversion of all R-12 systems to R-22. Velocity risers are not required when lines 351, 356 and 361 are graded downward to the compressor 301 location and no lift requirements are imposed. After leaving the double velocity riser through line 356, the refrigerant then passes into CPR 360 for return to the compressor 301 via line 361. CPR 360 is installed and balanced as described previously.

As shown in FIG. 3, the liquid refrigerant that is recirculated via line 369 for injection into and cooling of the compressor 301 originates from a point between the pump 322 and filter/dryer 325 at line 323. It is also possible that this liquid refrigerant could be taken from other points between the pump and the TXV, such as line 326 or line 331.

Because the pump acts to desuperheat the condenser, no additional condenser capacity is required by this embodiment and less refrigerant needs to be used. Instead of using the criteria previously set forth with respect to the charging of R-12 refrigerant in FIG. 1, it is now necessary only to add enough R-22 refrigerant to receiver 320 to fill that container one-fourth full or to provide adequate liquid seal on the suction side of pump 322.

In addition to the modifications shown on FIG. 3, the system should again be modified with respect to the metering devices (e.g., distributor, orifices, and expansion valves, including, for example, TXV 335), and the relief valves as described previously.

The following examples are illustrative of the invention as described previously and are not intended to limit the scope of the invention as defined by the claims.

EXAMPLE 1

The retrofit system was utilized on a medium temperature refrigeration system used for cooling dairy products contained in a typical supermarket in Houston, Tex. The refrigeration system included a single compressor (i.e., Copeland model 9RS20760TFC, rated for R-12). The system, which was designed for and utilized R-12 refrigerant, was intended to provide 32° to 33° F. discharge temperature for 36 foot long Hussmann dairy cases. The system also included a condenser and receiver. Following installation of the original system, it had never been able to achieve design temperature. At best, it had been able to achieve a minimum 35° F. discharge temperature to the dairy case.

The following modifications were made to convert the refrigeration system to the use of R-22 refrigerant:

1. Removed R-12 refrigerant;
2. Installed velocity risers (double pipe);
3. Replaced TXV R-12 to TXV R-22;
4. Replaced R-12 distributors to R-22 properly sized;
5. Replaced receiver R12 relief valve to R-22;
6. Installed liquid injection copper tube into compressor to inject between the motor and suction valves in suction line ahead of compressor;
7. Installed an EPR valve in suction line leaving evaporator "outlet;"
8. Installed liquid injection solenoid metering valve;

9. Installed liquid injection control module;
10. Replaced ORI R-12 valve to ORI R-22;
11. Replaced ORD R-12 valve to ORD4 R-22;
12. Dehydrated the system;
13. Charged system with new R-22 refrigerant;
14. Started system at maximum motor amperage of the compressor;
15. Adjusted EPR for proper evaporator pressure; and
16. Adjusted TXV for proper superheat.

On completion of tests and balancing of the retrofit system with these modifications, the performance of the system was improved and the design temperature of the dairy cases was obtained for the first time since installation of the original R-12 system. The discharge air temperature at the cases was consistent at 32.8° F., and the compressor operated within safe operating criteria. This system has proven successful through the monitoring of pressure, temperature, amperage, voltage and spectrographic oil analysis over an eight month period. Since essentially the same system could now achieve the design cooling requirements, which had previously been unobtainable, it is obvious that the retrofit R-22 refrigeration system operated more efficiently than the original R-12 system.

EXAMPLE 2

The same original R-12 refrigeration system identified in Example 1 could be modified in accordance with the preferred embodiment of this invention as follows:

1. Removed R-12 refrigerant;
2. Installed velocity risers (double pipe);
3. Replaced TXV R-12 to TXV R-22;
4. Replaced R-12 distributors to R-22—properly sized;
5. Replaced receiver R-12 relief valve to R-22;
6. Installed liquid injection copper tube into compressor to inject between the motor and suction valves of compressor;
7. Installed CPR valve in suction line ahead of compressor;
8. Installed an EPR valve in suction line leaving evaporator "outlet;"
9. Installed liquid injection solenoid metering valve;
10. Installed liquid injection control module;
11. Installed LPA pump;
12. Removed ORI R-12 valve;
13. Removed ORD valve;
14. Dehydrated system;
15. Charged system with new R-22 refrigerant;
16. Started system at maximum loading;
17. Adjusted CPR valve to maximum motor amperage of compressor;
18. Set all condenser fans for continuous operation;
19. Adjusted EPR for proper evaporator pressure; and
20. Adjusted TXV for proper superheat condensing temperature to allow to float proportional to outside ambient temperature for maximum savings.

The system would perform at least as well as the retrofit system of Example 1 and would permit additional energy savings.

While it will be apparent that the embodiments of the invention disclosed are well calculated to provide the advantages and features stated herein, it must be appreciated that the invention is susceptible to modification, variation and change without departing from the proper scope or fair meaning of the following claims. It is apparent, for example, that many variations of compression type refrigeration systems exist that vary from those described herein, but that the principles of the retrofit system of my invention can be applied thereto provided that these variations are taken into account.

I claim:

1. A method for converting a compression type refrigeration system designed for the use of R-12 refrigerant which systems comprises an evaporator, a compressor rated for R-12 use, a condenser and a receiver and conduit means interconnecting these devices to circulate the refrigerant through these devices in a continuous loop in the sequence named, to the use of R-22 refrigerant comprising:

installing a pressure regulator in the suction line to the compressor and balancing such regulator to the operating limitations of the compressor motor;

installing a line into the body of the compressor sufficient to inject liquid refrigerant into the compressor for cooling purposes; and attaching a desuperheating control to the refrigerant injection line to control the amount of refrigerant injected based upon the temperature inside the compressor.

2. The method of claim 1 which, in addition, includes the step of installing a pressure regulator at the outlet of the evaporator to maintain the desired temperature in the evaporator.

3. The method of claim 1 which, in addition, includes the steps of:

replacing existing R-12 distributors, orifices, and expansion valves with similar devices sized or rated for R-22 refrigerant;

replacing the head pressure controller with a device rated for R-22 refrigerant; and replacing any relief valves with valves rated for R-22 refrigerant.

4. The method of claim 2 which, in addition, includes the step of installing a double riser between the evaporator and the compressor to ensure the return of oil to the compressor at the various loads encountered by the system.

5. The method of claim 1 which, in addition, includes the step of installing a pump between the receiver and the evaporator to ensure that liquid refrigerant does not flash into vapor prior to entrance into the evaporator and to desuperheat the condenser.

6. The method of claim 1 in which the installation of the line into the body of the compressor includes the installation of a tube extending a sufficient length into the body of the compressor such that the liquid refrigerant injected into the compressor flashes as it leaves the line.

7. The method of claim 6 in which the tube is made of copper and is bent at the tip to direct the refrigerant leaving the tube toward the compressor wall to maximize the cooling of incoming suction gas.

8. In a method for converting a compression type refrigeration system designed for the use of R-12 refrigerant which system comprises an evaporator, a compressor rated for R-12 use, a condenser, and a receiver and conduit means interconnecting these devices to circulate the refrigerant through these devices in a continuous loop in the sequence named, to the use of R-22 refrigerant which method includes the steps of replacing existing R-12 distributors, orifices, and expansion valves with similar devices sized for R-22; replacing the head pressure controller with a device rated for R-22 refrigerant or eliminating it in its entirety; and replacing any relief valves with valves rated for R-22, the improvement comprising:

installing a pressure regulator in the suction line to the compressor and balancing such regulator to the operating limitations of the compressor motor;

attaching a desuperheating control to the refrigerant injection line to control the amount of refrigerant injected based upon the temperature inside the compressor; and installing a line into the body of the compressor sufficient to inject liquid refrigerant into the compressor for cooling purposes.

9. The method of claim 8 which, in addition, includes the step of installing a pressure regulator at the outlet of the evaporator to maintain the desired temperature in the evaporator.

10. The method of claim 9 which, in addition, includes the step of installing a pump between the receiver and the evaporator to ensure that liquid refrigerant does not flash into vapor prior to entrance into the evaporator and to desuperheat the condenser.

11. The method of claim 9 which, in addition, includes the step of installing a double riser between the evaporator and the compressor to ensure the return of oil to the compressor at the various loads encountered by the system.

12. The method of claim 11 in which the installation of the line into the body of the compressor includes the installation of a tube extending a sufficient length into the body of the compressor such that the liquid refrigerant injected into the compressor flashes as it leaves the line.

13. The method of claim 12 in which the tube is made of copper and is bent at the tip to direct the refrigerant leaving the tube toward the compressor wall to maximize the cooling of incoming suction gas.

14. A method for operating a compression type refrigeration system designed for operation utilizing R-12 refrigerant and which includes an evaporator, a compressor rated for operation with R-12 refrigerant, a condenser, a receiver; and conduit means interconnecting the evaporator, compressor, condenser, and receiver for passage of refrigerant through these devices in a continuous loop in the sequence named, with R-22 refrigerant instead, comprising;

regulating the pressure regulator in the suction line to the compressor balanced to the operating limitations of the compressor motor;

injecting liquid refrigerant into the body of the compressor for cooling purposes; and controlling the amount of refrigerant injected into the compressor utilizing a desuperheating control based upon the temperature inside the compressor.

15. The method of claim 14 which, in addition, includes regulating the pressure at the outlet of the evaporator to maintain design temperature in the evaporator.

16. The method of claim 14 which, in addition, includes adding sufficient pressure in the line between the receiver and the evaporator to ensure that liquid refrigerant does not flash into vapor prior to entrance into the evaporator and to desuperheat the condenser.

17. The method of claim 16 in which the refrigerant is injected into the body of the compressor through a tube extending a sufficient length into the body of the compressor such that the liquid refrigerant injected into the compressor flashes as it leaves the line.

* * * * *